United States Patent [19]

Vanderpool et al.

[11] Patent Number: 4,737,229

[45] Date of Patent: Apr. 12, 1988

[54] HAND-HELD LABELER HAVING IMPROVED WEB POSITION SENSING AND PRINT HEAD CONTROL

[75] Inventors: James L. Vanderpool, Kettering; James M. Bain, Xenia, both of Ohio

[73] Assignee: Monarch Marking Systems, Inc., Dayton, Ohio

[21] Appl. No.: 792,123

[22] Filed: Oct. 28, 1985

Related U.S. Application Data

[62] Division of Ser. No. 596,346, Apr. 3, 1984, Pat. No. 4,584,047.

[51] Int. Cl.[4] ..... B65C 9/46; B65C 11/02

[52] U.S. Cl. ..... 156/384; 101/93.04; 101/288; 156/577; 156/579; 156/584; 156/DIG. 47; 156/DIG. 49; 307/66; 346/76 PH; 400/120

[58] Field of Search ..... 156/384, 577, 579, 584, 156/DIG. 49, DIG. 47; 101/93.04, 93.05, 288; 346/76 PH; 400/120; 307/22, 26, 66

[56] References Cited

U.S. PATENT DOCUMENTS

| | | | |
|---|---|---|---|
| 3,249,769 | 5/1966 | Mierendorf | 307/66 |
| 4,209,710 | 6/1980 | Quarton | 307/66 |
| 4,264,396 | 4/1981 | Stewart | 101/93.05 |
| 4,377,972 | 3/1983 | O'Neil | 101/93.04 |
| 4,383,184 | 5/1983 | McFarland | 307/66 |
| 4,486,759 | 12/1984 | Toyomura | 346/76 PH |
| 4,654,922 | 1/1986 | Muller | 364/900 |

*Primary Examiner*—Michael Wityshyn

*Attorney, Agent, or Firm*—Mason, Kolehmainen, Rathburn & Wyss

[57] ABSTRACT

A hand-held labeler, particularly a labeler employing a thermographic print head, utilizes improved control circuitry for accurately sensing the position of the web and controlling the operation of the print head in order accurately to control the position of the imprints on the web. When a motor is used to advance the web, the control system is operative to control the operation and speed of the web advancing motor.

6 Claims, 5 Drawing Sheets

FIG-8
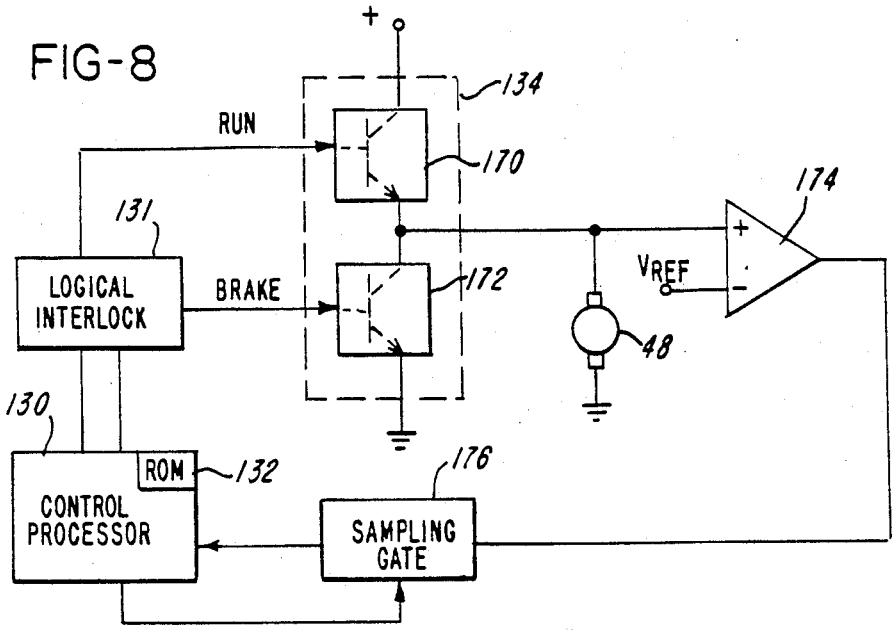
FIG-9
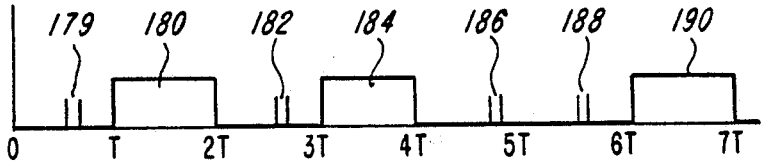
FIG-11
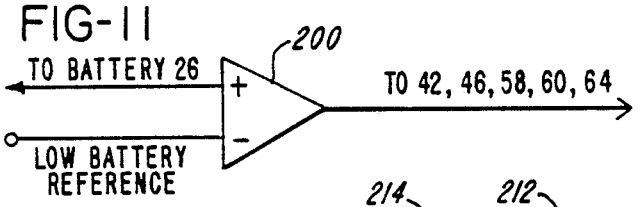
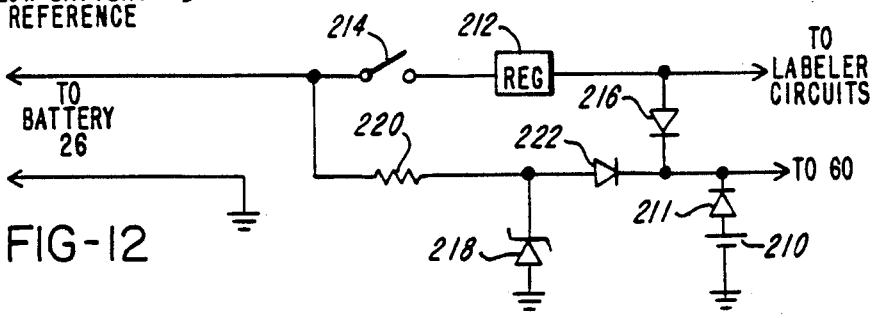
FIG-12

HAND-HELD LABELER HAVING IMPROVED WEB POSITION SENSING AND PRINT HEAD CONTROL

CROSS-REFERENCE TO RELATED APPLICATION

This is a divisional patent application of copending patent application Ser. No. 06/596,346, filed on Apr. 3, 1984, now U.S. Pat. No. 4,584,047.

BACKGROUND OF THE INVENTION

A. Field of the Invention

This invention relates generally to printing devices, and more particularly to hand-held labelers utilizing circuitry accurately to determine the position of the printing web, and to control the operation of the printing head, preferably a thermographic printing head, in response to position signals to thereby accurately position the imprints on the web.

B. Prior Art in the United States

Hand-held labelers utilizing thermographic printing devices are known. Examples of such hand-held labelers are illustrated in U.S. Pat. Nos. 4,264,396 to Stewart, 4,407,692 to Torbeck and U.S. patent application Ser. No. 485,012 filed Apr. 14, 1983.

While the devices disclosed in the above-described references do provide a way to make imprints on a thermosensitive web, they do not contain certain of the features provided by the device of the present invention. For example, when printing with a thermal printing device, particularly with a high density printing device such as one of the devices illustrated in the aforementioned U.S. Pat. No. 4,407,692 and application Ser. No. 485,012, it is necessary accurately to control the timing of the energization of the various printing elements as a function of the position of the web. For example, in such a system, the web is continously fed, and the appropriate printing elements must be energized at the precise time that the portion of the web on which the imprinting is desired is positioned adjacent the printing head. The difficulty of the problem is further compounded by the fact that each of the printing elements has a length and a width of only a few mils. As a result, the position of the web or the timing of the energization of the printing elements, must be precisely controlled to avoid printing gaps and changes in print density, as well as changes in character shape, particularly when the speed of the web varies as it passes the printing head, as for example, in the case of a labeler having a hand advanced web.

SUMMARY OF THE INVENTION

Accordingly, it is an object of the present invention to provide an improvement over the prior art systems.

It is another object of the present invention to provide a hand-held labeler that includes a system for precisely sensing the position of the web and controlling the energization of the printing elements in accordance with the web position in order to position the imprints on the web with great accuracy.

It is yet another object of the present invention to provide a hand-held labeler that utilizes a web position sensing system that is particularly usable with a thermographic printing device.

It is yet another object of the invention to provide a thermographic hand-held labeler that minimizes the possibility of damage to the printing device.

It is yet another object to provide a hand-held labeler having a system that senses the position of the web with great accuracy.

It is yet another object of the invention to provide a hand-held labeler that has a system that senses the position of the web to an accuracy of a few mils.

It is yet another object of the present invention to provide a hand-held labeler having a system that senses the position of the web and controls the printing device to compensate for variations in the speed of the web.

It is yet another object of the invention to provide a hand-held labeler that utilizes a web position sensing system that is usable with hand advanced and motorized web advancing mechanisms.

Therefore, in accordance with a preferred embodiment of the invention, there is provided a hand-held labeler utilizing a microprocessor-based control system that senses the position of the weo and controls the operation of the printing head in accordance with the position of the web in order to assure that any imprints are accurately positioned on the web, and on any labels cut from the web. The system employs a precise timing disc that is coupled to the label advancing mechanism. The timing disc cooperates with a sensor, such as, for example, an optical sensor that senses the position of indices on the timing disc, and provides a signal representative of web position. The timing disc includes at least one and preferably more home position indices that defines the boundary between two successive labels, one or more position determining indices and a warning index disposed adjacent to the label boundary defining index that informs the system that the label boundary is approaching. The indices are sensed by the sensor and used to provide position indicative signals to the system for controlling the operation of the printing head.

DESCRIPTION OF THE DRAWING

These and other objects and advantages of the present invention will become readily apparent upon consideration of the following detailed description and attached drawing, wherein:

FIG. 8 is a block diagram of the motor speed control portion of the control circuitry of the invention;

FIG. 9 is a timing diagram illustrating the operation of the motor speed control circuit according to the invention;

FIGS. 11 and 12 illustrate circuitry for protecting the data stored in the labeler in the event of a discharged battery and when the battery is removed.

DETAILED DESCRIPTION OF THE PREFERRED EMBODIMENT

Figure 1:
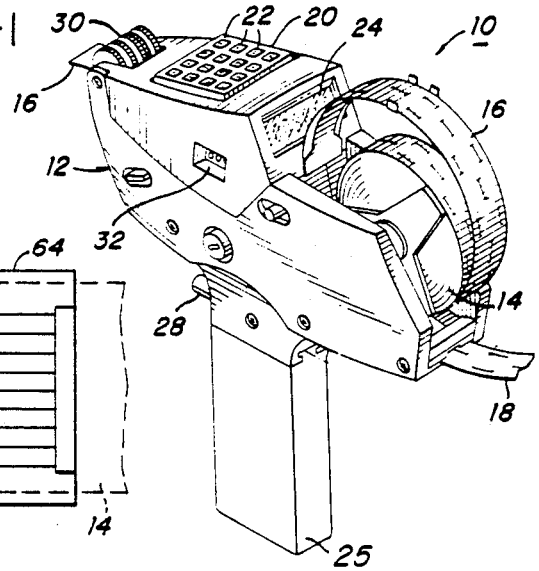
FIG. 1 is a perspective view of a hand-held labeler constructed in accordance with the principles of the present invention.

Referring now to the drawing, with particular attention to FIG. 1, there is shown a thermographic microprocessor-controlled hand-held labeler according to the invention, generally designated by the reference numeral 10. The labeler 10 includes a housing 12 that supports a roll 14 of adhesive backed labels 16 that are supported on a backing web 18. A keyboard 20 is disposed on the housing 12 and contains a plurality of individually operable key switches 22 for entering data into the labeler. A display 24, which may be a liquid crystal or light emitting diode display, is also disposed on the housing to permit the entered data and microprocessor-generated prompting instructions to be viewed by the operator. A battery pack, which may be contained in a removable battery pack-handle unit 25 containing a battery 26 having an internal resistance 27, provides electrical power for the labeler 10. A trigger 28 is provided to initiate the label printing operation, and a label applying roller 30 is used to apply pressure to the adhesive backed label 16 when the label 16 is being applied to an article of merchandise. A label stripper (not shown) is contained within the housing 12 to separate the labels 16 from the backing strip 18. A plurality of guide rollers are provided to guide the separated labels 16 to the forward portion of the housing beneath the label applying roller 30, and to guide the backing strip to the rear of the housing beneath the roll 14.

As previously stated, the labeler according to the invention is quite versatile and is capable of printing alphanumerics, as well as bar codes including the Universal Product Code (UPC) and the European Article Number (EAN). The type of format, whether alphanumeric or bar code, is readily selected by entering the appropriate format and fonts defining data via the keyboard 20. The data to be printed, for example, price, product defining data and other information about the product such as the size, color, etc. is also entered via the keyboard 20. In addition, the number of labels to be printed may be entered. Also, a data input/output connector 32, may be provided on the housing to permit data to be entered into the labeler by an external source, such as, a remotely-located computer, and to permit the battery 26 to be charged.

Figure 2:
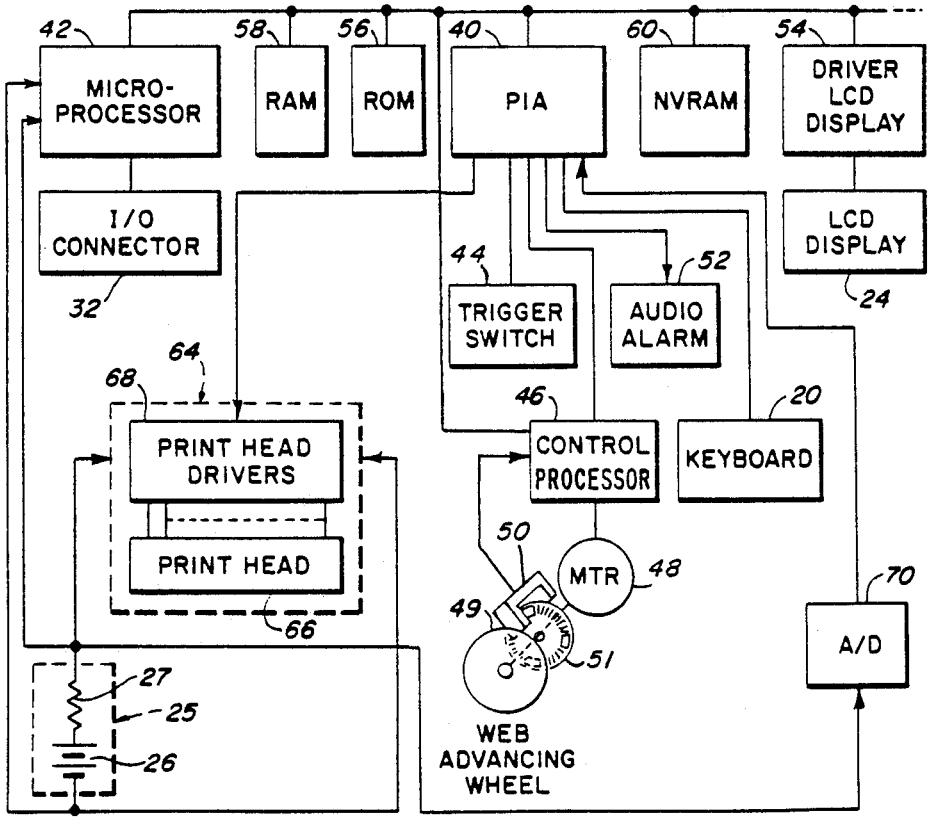
FIG. 2 is a system block diagram of the logic circuitry controlling the thermographic printing apparatus according to the invention.

Referring to FIG. 2, the keyboard 20 is coupled to a peripheral interface adapter (PIA) 40 which provides an interface between various input and output devices and a microprocessor 42. Also coupled to the peripheral interface adapter 40 are a trigger switch 44 that is controlled by the trigger 28, and a control circuit 46 that operates a motor 48 that drives a web advancing wheel 49. A detector 50 senses a mark or index on the web advancing wheel 49, or preferably on a separate timing disc 51. The control circuit 46 responds to data received from the microprocessor 42 and controls the operation of the web advancing motor 48, which may preferably be a D.C. motor. An audible alarm 52 is also connected to the peripheral interface adapter 40, and is useful for indicating to the operator that a problem or potential problem exits. For example, the audible alarm 52 may be used to indicate a discharged or faulty battery, a faulty print head, that the labeler is out of labels, a jam, or may simply be used to indicate that data entered into the device has been received. In the latter case, the audible alarm 52, can be used to provide an audible indication each time one of the key switches 22 on the keyboard 20 is depressed.

The display 24 is coupled to the microprocessor 42 via a display driver 54. The display 24 is used to display data being inputted into the microprocessor as well as other messages such, for example, prompting and diagnostic messages generated by the microprocessor. A read-only memory (ROM) 56 is provided for storing permanent data, such as the program defining operation of the device. The read-only memory 56 may either be permanently installed in the labeler 10, or may be removably installed in a socket or the like to permit the font and/or format to be changed by changing the memory 56. In addition, a random-access memory (RAM) 58, usable for storing short term data, such as data entered via the keyboard 20, is provided, as is a non-volatile random-access memory (NVRAM) 60, suitable for storing data such as format data. The input/output connector 32 provides communications between the device and an external computer. Printing is accomplished by a print head assembly 64 that contains a print head 66 and print head driver 68 coupled to the peripheral interface adapter 40. An analog-to-digital converter 70 coupled to the peripheral interface adapter 40 senses the battery voltage or the voltage applied to the print head assembly 64, and provides a digital indication of that voltage to the peripheral interface adapter 40 so that the microprocessor may adjust the time that the print head is energized to compensate for variations in battery or print head voltage.

Figure 3:
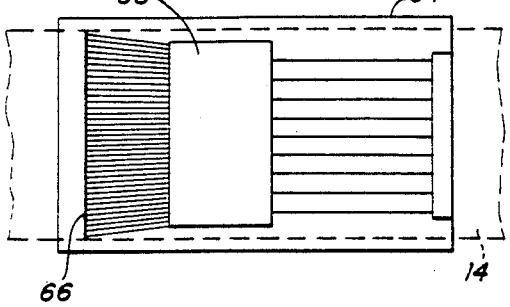
FIG. 3 is a plan view of a thermographic print head usable with the printing apparatus according to the present invention.

One example of the print head assembly 64 is illustrated in simplified form in FIG. 3. In the illustrated embodiment, the print head assembly 64 contains the print head driver 68 and the print head 66 disposed on a thin film substrate. The print head has a single line of print elements disposed transverse to the direction of travel of the web 18, and is particularly suitable for use in a hand-held labeler because of the high density of the print elements that make up the print head 66, particularly if both alphanumerics and bar codes are to be printed. One print head assembly particularly usable as the print head assembly 66 employs 224 printing elements that are each 10 mils long and 4.4 mils wide, and spaced on 5.2 mil centers. Such a configuration permits a virtually continuous line to be printed.

Each of the printing elements constitutes a resistive heating element 80 (FIG. 4) that is individually energizable by the print head driver circuitry 68 which contains a heater driver transistor 82 for each of the printing elements 80. A gate 84 controls each of the heater driver transistors 82, and an input register 86 and a data register 88 control the operation of the gates 84. Thus, if a 224-element head is used as the print head 66, 224 driver transistors 82 and 224 gates 84 must be provided, and the input register 86 and the data register 88 must each have at least 224 stages.

The input register 86 receives data serially from a data input line 90 under the control of clock signals applied to a clock line 92. When the input register 86 is full, the data is transferred in parallel to the data register 88 under the control of a latch signal applied to the data register 88 by a line 94. The input register 86 is then reset by a reset pulse applied to the reset line 96, and new data is supplied to the input register.

Because the resistive heating elements 80 draw a substantial amount of current, for example, approximately 50 milliamps per element, and because of the extreme density of the elements, for example, approximately 200 elements per inch, the current drain on the battery 26 would be excessive if all of the elements 80 were turned on simultaneously. For this reason, the heater driver transistors 82 are strooed by the gates 84 so that no more than one-fourth of the heater drivers 82 may be energized at any one time.

Figure 4:
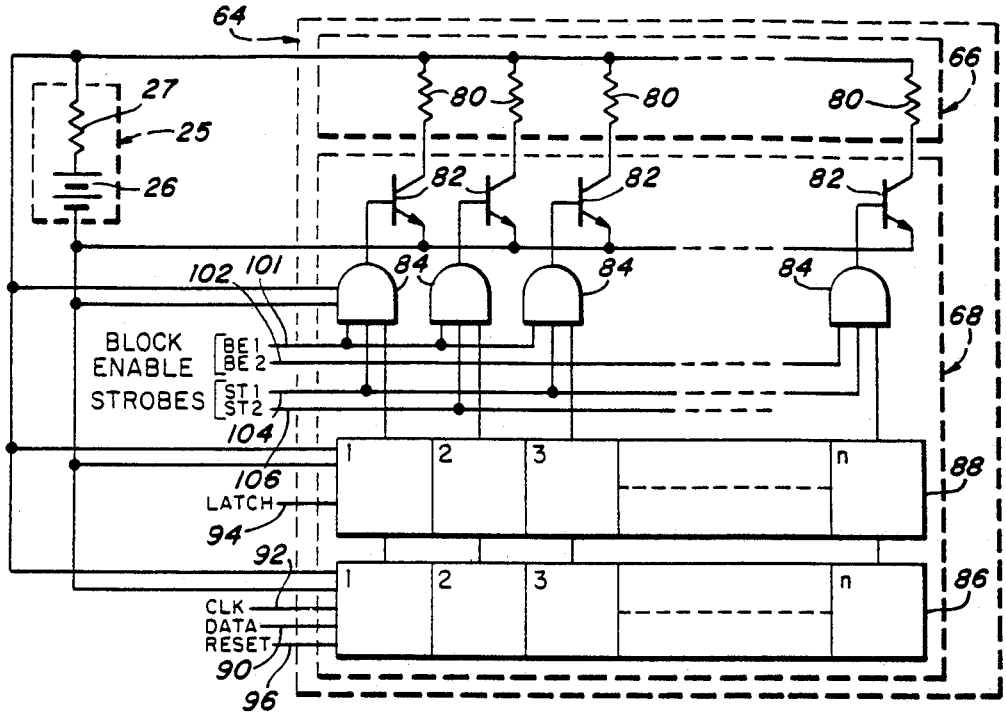
FIG. 4 is a block diagram illustrating one embodiment of the print head driving circuitry.

In the embodiment illustrated in FIG. 4, the strobing is accomplished by utilizing three input AND gates as the gates 84, and by enabling the gates 84 in blocks. This is accomplished by providing two block enable signals BE1 and BE2 on lines 100 and 102, respectively, and strobes ST1 and ST2 on lines 104 and 106, respectively. Each of the block enable signals is connected to one-half of the gates 84 so that one-half of the gates 84 are enabled when the BE1 signal is high, and the other half are enabled when the BE2 signal is high. The ST1 signal is applied to one-half of the gates 84 receiving the BE1 signal and to one-half of the gates 84 receiving the BE2 signal. Similarly, the ST2 signal is applied to the gates 84 not receiving the ST1 signal. Thus, since it is necessary for each gate to receive one of the block enable signals and one of the strobe signals in order to be fully enabled, only one-fourth of the gates 84 are enabled at any given time. Thus, the data from the data register 88 is applied to the heater driver transistors 82 in four steps, so that no more than one-fourth of the transistors 82 may be energized at a given time.

Figure 5:
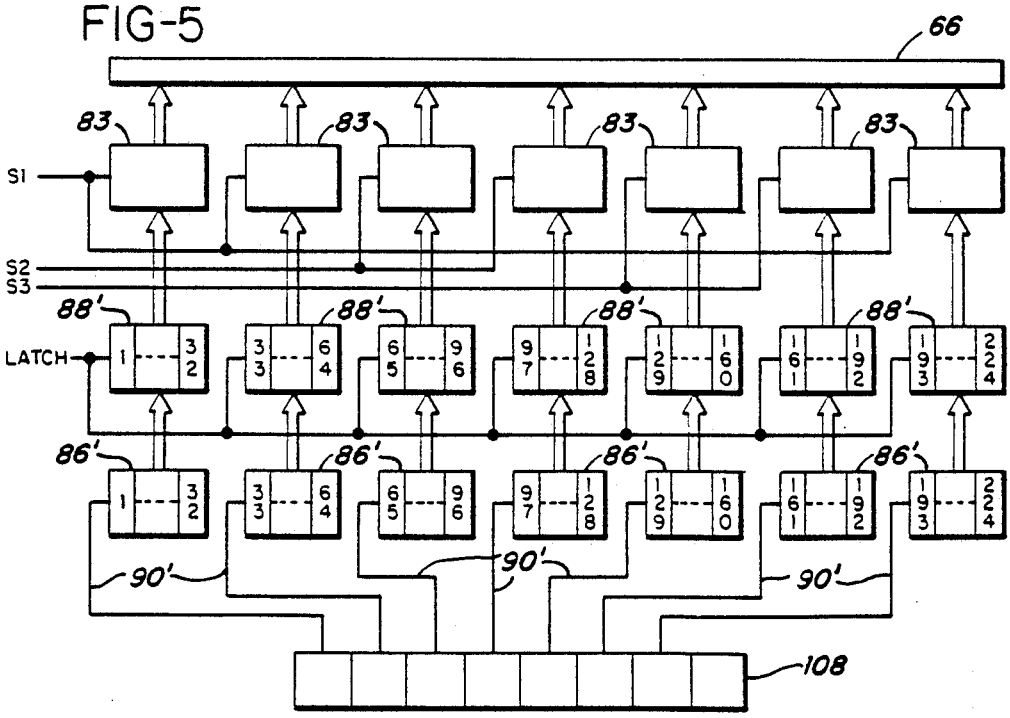
FIG. 5 is a block diagram of an alternative embodiment of the print head driving circuitry.

An alternative embodiment of the print head driving mechanism is illustrated in FIG. 5. The embodiment illustrated in FIG. 5 is similar to the one illustrated in FIG. 4, except that the input register 86 is broken up into a plurality of smaller registers, for example, seven 32-stage shift registers 86'in the illustrated embodiment. Such an arrangement has the advantage that it permits data to be entered more rapidly into the system, thereby permitting a faster printing speed. This occurs because each of the seven shift registers 86' can be fed in parallel from said seven separate data lines 90'. Consequently, the data need be shifted only 32 times to load the registers 86', as opposed to the 224 shifts required to load the input register 86. However, when loading the shift registers 86' the 224 bits defining each line cannot be fed serially into the shift registers 86', but the bits must be grouped so that they may be applied to the appropriate registers. This is accomplished by taking every 32nd bit from the data defining a line, and applying it to the appropriate one of the shift registers 86'. For example, if 224 bits are used to define a line, the 32nd, 64th, 96th, 128th, 160th, 192nd and 224th bits are selected and applied to seven stages of a buffer 108 (FIG. 5). These bits are then applied in parallel to the shift registers 86'. Next, the 31st, 63rd, 95th, 127th, 159th, 191st and 223rd bits are applied to the buffer 108 and shifted to the registers 86'. The process is repeated until the first, 33rd, 65th, 97th, 129th, 161st and 193rd bits are loaded into the buffer 108 and supplied to the registers 86'. At this point, the seven registers 86' contain the bits 1-32, 33-64, 65-96, 97-128, 129-160, 161-192 and 193-224. Since this data completely defines a line, the data from the registers 86' can be transferred to a data register, such as the data register 88 (FIG. 4), or to a plurality of individual data registers 88' (FIG. 5). The output of the data register 88' can be applied to a plurality of three-input AND gates 84, or to any suitable device for limiting the number of individual elements that can be simultaneously energized.

In FIG. 5, the strobe function that limits the number of elements that can be simultaneously energized is provided by a plurality of circuits 83. Each of the circuits 83 contains 32 two-input AND gates and appropriate driving circuitry for driving the print head 66. Such a system is somewhat simpler than the system illustrated in FIG. 4 because only two-input AND gates, rather than three-input AND gates, are required. By providing three strobe signals S1, S2 and S3, the number of printing elements that can be simulataneously energized is restricted to approximately one-third of the total number of print elements.

In the embodiment illustrated in FIG. 5, the strobe signal S1 is applied to the first two and the last one of the circuits 83. The strobe signal S2 is applied to the third and fourth ones of the circuits 83, and the strobe signal S3 is applied to the fifth and sixth ones of the circuits 83. Consequently, no more than two out of seven printing elements may be simultaneously energized when either the strobe signal S2 or the strobe signal S3 is present. Theoretically, as many as three out of seven elements may be energized when the strobe signal S1 is present, but in practice, the line of print is seldom as wide as the width of the print head 66, and consequently, it is unlikely that more than one-half of the total elements in the first and last ones of the circuits 83 would be energized.

The control circuit 46 (FIG. 6) includes a control processor 130 that includes a read-only memory (ROM) 132 that may be located either on the same integrated circuit as the control processor 130 or in a separate package. The various components required to carry out the print control function are not shown in FIG. 6 for purposes of clarity; however, it should be understood that the microprocessor 42 of FIG. 6 must be coupled to components that are the same or analogous to the components shown in FIG. 2 to provide the printing function. The control processor 130 controls a motor drive/brake circuit 134 that selectively applies energizing or dynamic braking currents to the motor 48. An analog-to-digital converter 136 measures the back EMF of the motor 48 when it is coasting, and applies a digital representation of the back EMF to the control processor 130 in order to provide an indication of the speed of the motor 48 to the control processor 130. The detector 50 includes a light source, such as, for example, a light emitting diode 138 and a light sensitive device such as a photodetector 140 disposed on opposite sides of the timing disc 51. The detector 50 serves to detect indices formed as a series of light contrasting marks such as opaque and transparent portions on the disc 51. Preferably, the indices are fabricated as a series of apertures about the periphery of the disc 51 which are used to indicate to the system the position of the disc 51, and consequently, the position of the web 18 as it is advanced oy tne advancing wheel 49. Although, an optical system is used to detect the position of the disc 51, other systems may also be used.

Figure 7:
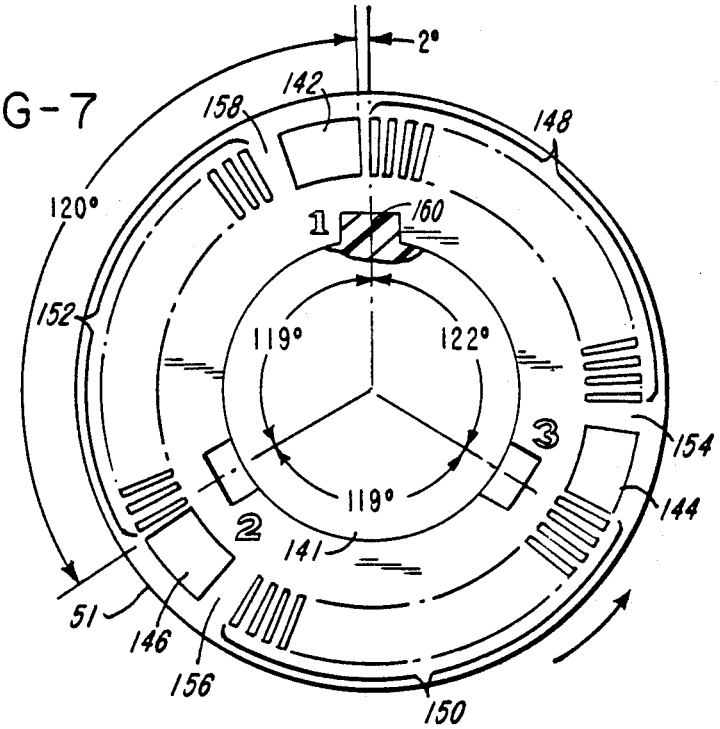
FIG. 7 is a detailed illustration of the timing disc illustrated in FIG. 6.

The timing disc 51 is illustrated in greater detail in FIG. 7. The disc illustrated in FIG. 7 is fabricated from an opaque material. Because of the relatively small size of the disc 51, for example, on the order of approximately 1.25 inches in diameter, and because of the precise tolerances required, the use of electro-deposited nickel provides a convenient way to fabricate the disc. The thickness of the disc 51 is nominally 3 mils, but may vary from 2 mils to 4 mils.

Figure 6:
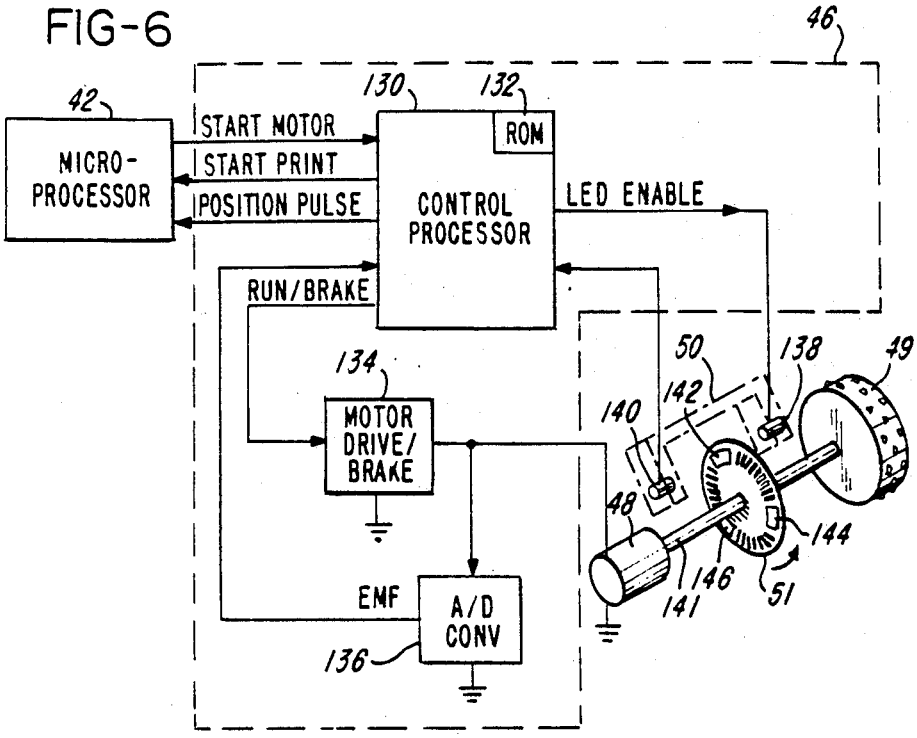
FIG. 6 is a block diagram illustrating the position sensing and printer control circuitry according to the invention.

As is illustrated in FIG. 6, the disc 51 is mounted on the same shaft (shaft 141) as is the web advancing wheel 49 and rotates therewith to form a shaft encoder. In the illustrated embodiment, the wheel 49 rotates one-third of a revolution each time a complete label is fed. Three home position indices in the form of three apertures 142, 144 and 146 are provided in the disc 51. In the illustrated embodiment, three home position indices are provided because the disc 51 rotates one third of a revolution each time a label is fed; however, it should be understood that if the advancing mechanism were modified such that the disc 51 rotated at a different rate, the number of home position indices would have to be changed accordingly. For example, if the disc 51 rotated one fourth of a revolution each time a label was fed, a disc with four home position indices would be used.

Following each of the apertures 142, 144 and 146 is a plurality of position defining indices in the form of a plurality of apertures or slots 148, 150 and 152, respectively (FIG. 7), which accurately define the position of the label with respect to the printing head. Although the position defining indices 148, 150 and 152 can be referred to as either apertures or slots, or by other terminology they will be referred to as slots in the following description for purposes of clarity in order to better distinguish them from the home position apertures 142, 144 and 146. A warning track is provided ahead of each of the home position indices in the form of three widened areas 154, 156 and 158.

When no labels are being printed, one of the home position defining apertures 142, 144, or 146 is aligned with the sensor 50. Each of the apertures 142, 144, and 146 is sufficiently wide to permit some backlash in the web and drive train to occur without causing an opaque area of the disc 51 to be detected by the sensor 50. This prevents the motor 48 from hunting in an attempt to keep one of the home position apertures aligned with the sensor 50. The size of the apertures 142, 144 and 146 is also selected to permit any slack in the web 18 to be taken up before one of the position defining indices is moved into alignment with the detector 50.

The width of the position defining slots 148, 150 and 152 and the width of the areas between the position defining slots is selected such that the distance between the detection of successive edges of the slots 148, 150 and 152 corresponds to a web movement that is equal to an integral multiple of the length of the print elements 80. For example, when a printing head such as the previously described printing head 66 is used, the distance between the detection of adjacent edges of the slots 148, 150 and 152 corresponds to a web travel that is equal to an integral multiple of 10 mils (the length of the print elements 80). In the timing disc 51 illustrated in FIG. 7, the integral multiple has been selected to be equal to two, thus providing a web travel of 20 mils between the detection of successive edges of the slots 148, 150 and 152. As a result, the position of the web 14 is defined in 20 mil increments.

The width of-each of the warning tracks defined by the widened areas 154, 156 and 158 must be made wide enough to permit the warning tracks to be distinguished from the areas between the position defining slots. In the embodiment illustrated in FIG. 7, the width of the areas 154, 156 and 158 is selected to be approximately twice as wide as the widths of the areas separating the slots 148, 150 and 152. This provides a warning track having a width that corresponds to approximately four times the length of the printing elements 80, or approximately 40 mils. The width of the areas 154, 156 and 158 is selected such that the areas 154, 156 and 158 can be readily distinguished from the narrower areas separating the slots 148, 150 and 152, and although in the embodiment illustrated in FIG. 7, the widened areas 154, 156 and 158 have been selected to be approximately twice as wide as the areas separating the slots 148, 150 and 152, other widths may be used.

In operation, when the labeler is not printing a label, one of the home position defining indices, for example, the aperture 142 is aligned with the detector 50. When the trigger switch 44 (or other manually operable switch) is depressed, the microprocessor 42 (FIG. 6) issues a start motor commano to the control processor 130 which in turn renders the motor drive/brake circuit 134 operative to energize the motor 48. The light-emitting diode 138 is also enabled. When the motor 48 is energized, the timing disc 51 is rotated in the direction shown by the arrows in FIGS. 6 and 7. As the motor rotates, any slack present in the web 18 and any backlash in any of the web advancing mechanism is taken up while a portion of the aperture 142 is still aligned with the detector 50. The motor 48 continues to rotate until the trailing edge of the aperture 142 is detected by the detector 50. At this point, all slack in the system has been taken up and the motor 48 is up to operating speed.

When the trailing edge of the aperture 142 is detected by the detector 50, the amplitude of the signal applied by the photodetector 140 to the control processor 130 changes. The control processor 130 responds to this change by issuing a start print command to the microprocessor 42. The start print signal indicates to the microprocessor 42 that the motor is up to speed and the web is positioned to accept printing at the printing positions defined by the selected print format.

As the motor 48 continues to rotate, the transitions between the slots 148 and the opaque areas disposed therebetween are detected by the photodetector 140, and signals representative of the transitions are applied to the control processor 130. The control processor 130 responds to the transitions and generates a position pulse signal and applies it to the microprocessor 42 each time a transition occurs. The position signals are counted by the microprocessor 42 in order to determine the position of the label with respect to the print head 66. When the print head 66 is positioned over a print area on the label, as defined, for example, by the print format, the entered data is printed on the labels 16. The process continues with the microprocessor 42 receiving position pulse signals from the control processor 130 until the entered data is printed on one or more print areas of the labels 16.

As the printing process continues, the timing disc 51 continues to rotate until the warning track defined by the widened area 154 is detected. The widened area 154 is detected by the control processor 130 when the length of time that an opaque area is being detected by the photodetector 140 exceeds the length of time between the transition pulses generated by the slots 148 by a predetermined amount. Once it has been determined that a warning track such as the area 154 has been detected, the microprocessor is conditioned to respond to the next transition by rendering the motor drive/brake circuit 134 operative to brake the motor 48. Thus, when the leading edge of the aperture 144 is detected, a brake signal is applied to the motor drive/brake circuit 134 to cause the motor drive/brake circuit 134 to shunt the armature winding of the motor 48 to thereby dynamically brake the motor 48. The motor 48 continues to coast for a short distance until the aperture 144 is aligned with the detector 50, and the printing process is terminated. If it is desired to print another label, the trigger switch 44 is again depressed and another label is printed as the disc 51 is advanced until the aperture 146 is aligned with the detector 50.

Also, although the timing disc 51 is shown in conjunction with a motor driven advancing mechanism, it may also be used in conjunction with a hand or manually operated advancing mechanism. In such an event, even though the signals provided by the timing disc 51 would not be used to control a motor, the position signals would still be used to indicate to the microprocessor when a printable area is beneath the print head, and cause printing to be initiated when such an area is present.

As previously stated, the timing disc 51 provides very accurate information defining the position of the web. However, in order to make use of the accurate position signals provided by the timing disc 51, it is necessary to compensate for manufacturing tolerances present in the web advancing mechanism and in the positioning of the print head 66. Consequently, in accordance with another aspect of the present invention, there is provided a way to alter the angular position of the timing disc 51 with respect to the angular position of the web advancing wheel 49. Various other keying means could be used to affix the disc 51 to the shaft. For example, a slot could be provided on the shaft, and slot engaging members could be provided on the disc. Alternatively, the shaft could be provided with a plurality of keys or keyslots, and the disc 51 provided with a single keyslot or slot engaging member. Other variations could be used. In the illustrated embodiment, this is accomplished by mounting the timing disc 51 on a keyed shaft and providing a plurality of offset keyslots on the disc 51. Each of the offset keyslots is associated with one of the home position indices 142, 144 and 146 and is offset therefrom by the amount of adjustment required. Thus, any required adjustment may be obtained by positioning the appropriate slot on the key of the shaft.

For example, in the timing disc illustrated in FIG. 7, three keyways captioned 1, 2 and 3 are shown. The angular displacement between the keyways 1 and 3 is nominally 122°, while the angular displacement between the keyways 1 and 2, and 2 and 3 is nominally 119°. This compares with a 120° angular displacement between the leading edges of the apertures 142, 144 and 146, and permits a ±1° adjustment of the disc 51 relative to the web advancing wheel 49 and the detector 50.

If for example, the keyway designated by the numeral 1 were keyed to the shaft 141 by a key 160, the trailing edge of the aperture 142 will lead the center line of the key 160 by approximately 2°. The 2° offset shall be called the minus 1° position. If the keyway captioned by the numeral 3 is keyed to the key 160, because the keyways 1 and 3 are spaced by 122°, the trailing edge of the aperture 144 will lead the center of the key 160 by 4°, thus resulting in a positive 2° shift in the position of the positioning slots with respect to the minus 1° position. Adding 2° to minus 1° results in positive 1°, so this position can be considered the plus 1° position. If the keyway captioned by the numeral 2 is keyed to the key 160, the disc 51 will have been rotated a total of 122° plus 119° or 241° relative to its position when keyed to keyway number 1, thus resulting in a positive 1° shift in the position of the positioning slots relative to the minus 1° position. Thus, this position becomes the zero degree position, and positive and negative 1 degree adjustments of the disc 51 relative to the zero degree position may be readily attained. Other adjustments may be achieved by altering offsets between the keyways 1, 2 and 3. For example, a ±2° adjustment by spacing the keyway captioned 3 by 124° from the keyway captioned 1, and by spacing the keyway captioned 2 by 118° from the keyways captioned 1 and 3. In general, any offset may be achieved by appropriately spacing the keyways 1 and 3 by the total desired positive and negative offset added to 120°. If equal positive and negative offsets are desired, such equal positive and negative offsets may be achieved by dividing the remainder of the 360° are between the keyways captioned 2 and the keyways captioned 1 and 3.

Although various types of motors, including stepping motors, are usable as the web advancing motor 48, it has been found that a D.C. motor is particularly useful as the web advancing motor 48, partly because of its good low speed torque characeristics. However, when a D.C. motor is used, it is necessary to provide circuitry for controlling the speed of the motor shaft. In the present embodiment, the motor speed control is provided by the control processor 130. As previously discussed, the control processor 130 receives signals representative of the back EMF generated by the motor 48 when it is coasting, and adjusts the drive signal applied to the motor 48 to thereby maintain the speed of the motor 48 substantially constant.

Referring to FIG. 8, the motor 48 is driven by the motor drive/brake circuit 134 which includes a transistor drive circuit 170 that applies an energizing potential to the motor 48 when a run signal is received from the control processor 130. An interlock circuit prevents both the run and brake signals from being applied to the drive/brake circuit 134 simultaneously in the event of a microprocessor or other malfunction. The motor drive/brake circuit 134 also includes a dynamic braking circuit 172 that shunts the armature of the motor 48 to provide dynamic braking when a brake signal is received from the control processor 130. A comparator 174 is connected to the motor 48 and serves to compare the back EMF generated by the motor 48 when it is coasting with a reference voltage. A sampling gate 176 couples the output of the comparator 174 to the control processor 130.

The run signal applied to the drive circuit 170 includes a series of pulses which cause the drive circuit 170 to energize the motor 48 at periodic intervals. The back EMF generated by the motor 48 between drive pulses is sampled by the comparator 174 and the sampling gate 176, which operate as an analog-to-digital converter, to indicate to the control processor 130 whether the back EMF generated by the motor 48 is greater than or less than the reference voltage applied to the comparator 174. If the back EMF is less than the reference voltage, the next run pulse is generated by the control processor 130 again to energize the motor 48. If the back EMF generated by the motor 48 is greater than the reference voltage, indicating that the speed of the motor is excessive, the next run pulse is eliminated, and the motor is allowed to coast. During the coasting period the back EMF is measured at periodic intervals until it drops below the reference voltage, at which point another run pulse is generated. The speed of the motor may be adjusted by adjusting the reference voltage.

The run pulse generation and back EMF sampling is illustrated in greater detail in FIG. 9. Referring to FIG. 9, the back EMF is sampled during a first sampling period 179 occurring during a portion of the time interval ranging from zero to T. If the back EMF is less than the reference a run pulse, as illustrated by the pulse 180 is generated during the time interval between T and 2T. The duration of the pulse 180 is controlled by the clock (not shown) in the control processor 130, and is preferably on the order of 500 microseconds to 1 millisecond. No sample is taken during the time interval between T and 2T because such a sample would be meaningless because all that would be measured would be the amplitude of the pulse 180.

After the run pulse 180 has been terminated at the time 2T, the drive to the motor 48 is also terminated; however, the termination of the drive to the motor 48 results in a transient across the armature winding of the motor 48. Consequently, the voltage across the motor 48 is not immediately sampled because it is not representative of the back EMF being generated by the motor. Instead, the sampling is delayed until a sampling period 182 that follows the time 2T by a time interval sufficient to allow the transient to die down. It has been determined that delaying the sampling period 182 for approximately 300 microseconds following the termination of a run pulse allows enough of the transient to die down to permit an accurate reading of the back EMF of the motor 48 to be made; however, the delay time is dependent on the size and inductance of the motor, as well as other factors, and other values may be used depending on the particular components used. The sampling is done under the control of the sampling gate 176 which is enabled during the sampling period 182 and other sampling periods by the microprocessor 130.

If the back EMF measured during the sampling period 182 is too low, another run pulse 184 is generated during the time interval between 3T and 4T, and the back EMF is again sampled during a sampling period 186 occurring prior to the time 5T. If the back EMF during the sampling period 186 is again too low, another run pulse will be generated at time 5T; however, if the back EMF is higher than the reference voltage, no run pulse will be generated at time 5T, as is illustrated in FIG. 9. Rather, the back EMF will be sampled during a subsequent sampling interval 188 prior to the time 6T, and if the back EMF has dropped below the reference voltage, another run pulse 190 will be generated at the time 6T. The process will be repeated at periodic intervals with the run pulses being eliminated as required to maintain the speed of the motor 48 substantially constant.

Figure 10:
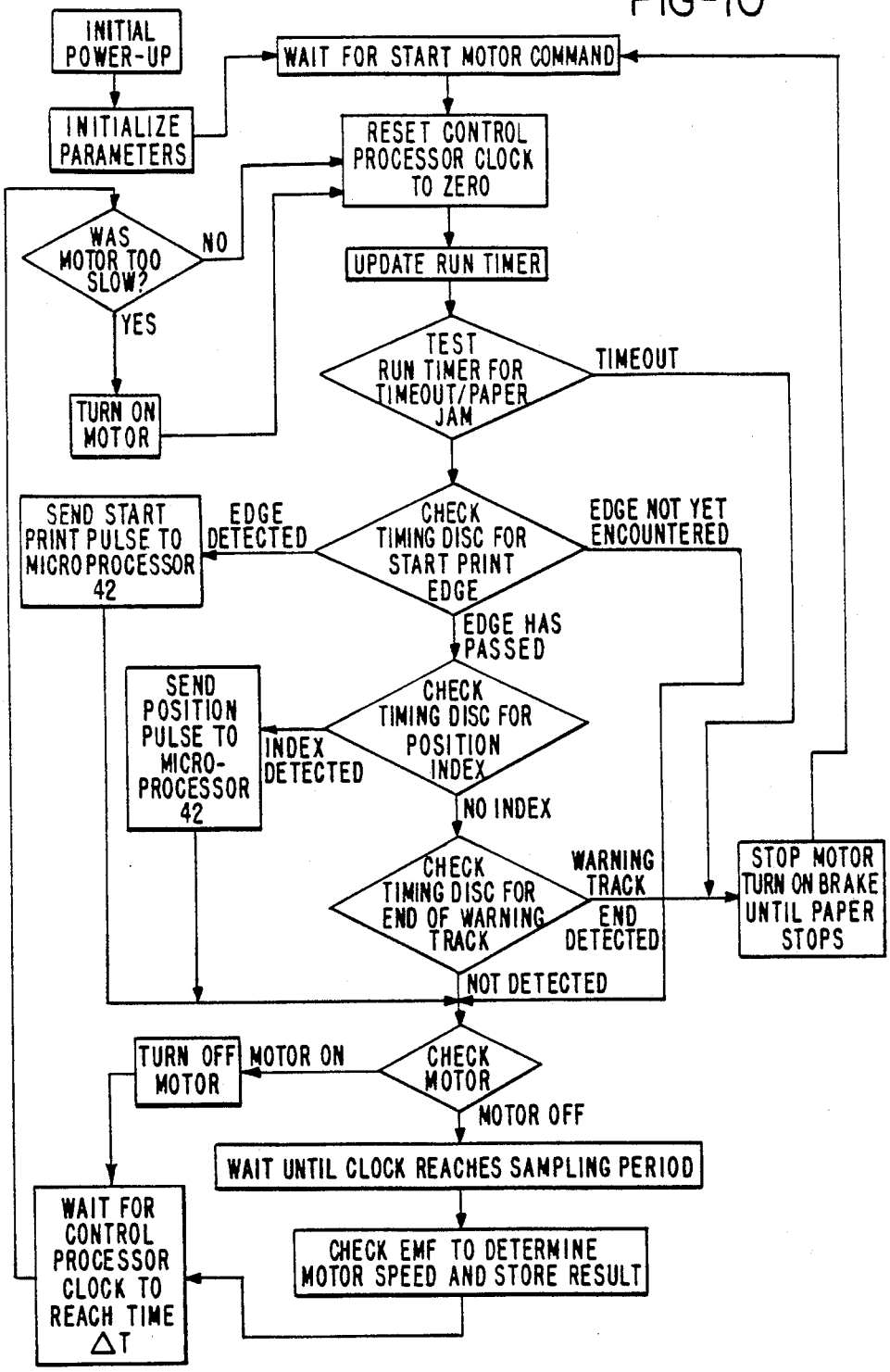
FIG. 10 is a logical flow diagram illustrating the operation of the control circuit according to the invention.

Referring now to FIG. 10, when the labeler is initially energized, the parameters in the microprocessor 42 and the control processor 46 are initialized, and the control processor 46 is conditioned to initiate the feeding of the web upon receipt of a start pulse from the microprocessor 42. Upon receipt of a start pulse, a clock in the control processor 46 is reset to zero. Subsequently, a separate timer is updated to indicate how many times the control processor clock has been reset. This provides an indication of how long the motor 48 has been running. If the time exceeds a predetermined limit, the run timer times out, the motor is stopped and braked, and the control processor 46 is conditioned to await the next start pulse. A signal may also be sent to the audio alarm 52 to indicate a jam. If no timeout occurs, the detector 50 is sampled to determine whether a start print edge (first opaque edge after home position aperture, FIG. 7) has been encountered. If the edge has been detected, a start print pulse is sent to the microprocessor 42, and the condition of the motor is checked, as is described later. If the edge passed previously, the timing disc is checked for a position index. If a position index is detected, a position pulse is sent to the microprocessor 42. If no index is detected, the timing disc is checked for the presence of the warning track (widened opaque area, FIG. 7). The widened area can be readily determined by the length of time it is aligned with the sensor 50. When the end of the warning track is detected, the motor is stopped, the brake is turned on for a predetermined time interval, and the control processor is conditioned to await the next start motor command.

The purpose of the above-described steps is to determine the position of the timing disc, and hence the position of the label during the printing cycle. In addition to determining the position of the label, the speed of the motor must be determined. In the logic diagram illustrated in FIG. 10, the motor speed check is made subsequent to each position check. Thus, if the run timer has not timed out, and the end of the warning track has not yet been detected, a motor speed check is made. This is accomplished by first checking the motor to see if it is on or off. If the motor is off, the system waits until a sampling period is reached. When the sampling period is reached, the back EMF is checked to determine motor speed. The result of the check, indicating whether the motor speed is too fast or too slow, is stored. If the motor is on, no speed check can be made, and the motor is turned off.

After the back EMF has been checked, or after the motor has been turned off, the system waits for the processor clock to reach time $\Delta T$, that is, the next time at which a run pulse can be generated. When the time $\Delta T$ is reached, the stored result is checked to determine whether the motor speed was too slow. If the motor speed had been too slow, the motor is turned on, the control processor clock is reset to zero, the run time is updated to include the time accumulated by the processor clock during the last cycle, and the cycle is repeated. If the speed of the motor was not too slow, the motor is not turned on before the processor clock is reset to zero and the run timer updated. In the event that the motor was previously on, and no back EMF check was made and stored, it is assumed that the motor speed was not too slow, and the processor clock is reset to zero without turning on the motor. Because the motor is now off, a speed check can be readily made during the next cycle.

As previously discussed, the labeler according to the invention is a hand-held labeler that is powered by a battery. As in the case of all battery-powered devices, the voltage applied to the various circuits drops as the battery discharges, and may even reacn zero when the battery is completely discharged or is removed. Such voltage variations can cause serious problems. For example, when the voltage applied to a microprocessor drops below a predetermined level, the operation of the microprocessor becomes erratic. When this occurs, the erratic signals from the microprocessor can alter or erase the data stored in the various memories. The processor can also cause damage to the print head, for example, by continuously energizing one or more of the printing elements. In addition, when a non-volatile RAM, such as the NVRAM 60, is used, a drop or loss of battery voltage can cause the data stored in the NVRAM to be lost.

Thus, in accordance with another aspect of the present invention, there is provided a circuit (FIG. 11) that monitors the voltage produced by the main battery, such as, the battery 26, and protects the various memories and the print head in the event of a low battery condition, and in the event that the battery is removed. This is accomplished by a comparator 200 that compares the voltage at the battery 26 with a low battery voltage reference. In the event that the voltage provided by the battery 26 drops below the low battery reference potential, the comparator 200 applies a signal to the microprocessor 42 and to the control processor 46 in order to put the processors in a reset condition to prevent erratic operation thereof. In addition, the comparator 200 applies a disabling signal to the RAM 58 and the NVRAM 60 to prevent data from being written onto or erased from the RAMs. A disabling signal is also applied to the print head 64 to clamp the print head driver 68 to thereby prevent energization of the print head 66. Thus, the RAMs and the print head are effectively protected from erratic operation of the microprocessors.

In order to prevent the loss of data from a non-volatile read-only memory such as the NVRAM 60, a back-up battery, such as, for example, a lithium battery 210 (FIG. 12), is provided. The use of a lithium battery for such a purpose is particularly advantageous because such batteries have a relatively long shelf life, on the order of approximately ten years. However, if the lithium battery were used to power the NVRAM for extended periods of time, it would become discharged relatively rapidly. Therefore, some means must be provided to prevent the back-up battery 210 from discharging prematurely. Thus, when the labeler is turned on, the NVRAM 60 is powered from the main battery, such as the battery 26; however, some provision must be provided to power the NVRAM 60 when the labeler is stored in an off condition for an extended period of time.

In the hand-held labeler according to the invention, the labeler circuits are powered by the battery 26 which is connected to a voltage regulator 212 via an on-off switch 214 (both not shown in FIG. 2). The regulator 212 provides a regulated voltage, for example, 5.6 volts, to the labeler circuits whenever the on-off switch 214 is closed. Under these conditions, the output voltage of the regulator 212 is applied to the NVRAM 60 by means of a blocking diode 216, and the NVRAM 60 is powered by the battery 26 via the switch 214, the regulator 212 and the diode 216 whenever the labeler is operating. A diode 211 isolates the battery 210 from the rest of the circuitry under these conditions because the voltage applied to the NVRAM 60 is higher than the voltage of the battery 210, and the diode 211 is reverse biased.

When the labeler is turned off, the output voltage of the regulator 212 is zero, and consequently, if the labeler is stored for an appreciable length of time, the back-up battery 210 will eventually discharge if the regulator 212 were relied on to power the NVRAM 60. Therefore, in accordance with another important aspect of the present invention, there is provided an auxiliary circuit that powers the NVRAM 60 even when the labeler is off. The auxiliary circuit includes a Zener diode 218 that is coupled to the battery side of the switch 214 by a resistor 220. The junction of the resistor 220 and the Zener diode 218 is coupled to the NVRAM 60 by another blocking diode 222. Thus, when the switch 214 is open, the NVRAM 60 is powered by the auxiliary circuit. As in the case when the switch 214 is on, the diode 211 isolates the battery 210 from the rest of the circuitry as long as the battery 26 is present and active. By making the voltage of the Zener diode 218 lower than the output voltage of the regulator 212, for example, 4.2 volts, interaction between the two circuits is eliminated. For example, when the switch 214 is closed, the voltage appearing at the cathode of the blocking diode 222 is greater than the voltage appearing at its anode. This reverse biases the diode 222 and prevents currents from flowing from the regulator 212 into the Zener diode 218 and discharging the battery 26. When the switch 214 is open, the blocking diode 216 is reverse biased, thus preventing the labeler circuitry from discharging the batteries 26 and 210. If the battery 26 is removed, or becomes discharged, the diode 211 becomes forward biased and the NVRAM 60 is powered by the battery 211. Under these conditions, the diodes 216 and 222 isolate the battery 211 from all of the labeler circuitry other than the NVRAM 60.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A hand-held labeling machine comprising; a housing having a manually engageable handle, the housing having means for holding a label supply roll of a composite web having labels releaseably adhered to a backing strip, means for connecting a first source of electrical energy to said labeling machine, an on-off switch interposed between said connecting means and said labeling machine and having a first terminal coupled to said connecting means and a second terminal coupled to said labeler, means for printing on a label at a printing position, means for peeling the printed label from the backing strip, label applying means disposed adjacent the peeling means, means for advancing the web to peel a printed label from the backing strip at the peeling means and advance the printed label into label applying relationship with the label applying means and to advance another label into the printing position, means for entering selected data to be printed, the printing means including a thermographic print head having a plurality of individually selectable print elements powered by the source of electrical energy for printing on a thermographic label at the printing position, means coupled to said data entering means for electrically processing the selected data and energizing the individual print elements in a predetermined sequence determined by the selected data to print data on the label, said processing means including memory means of the type requiring the continuous application of electrical energy thereto to maintain the memory function, circuit means having first means electrically coupled to said second terminal for automatically applying electrical energy from said source to said labeling machine and said memory means when said on-off switch is on, said circuit means having second means electrically coupled to said first terminal for automatically applying electrical energy from said source to said memory means when said on-off switch is off, said circuit means further including third means electrically coupled to a second source of electrical energy for automatically applying electrical energy from said second source of electrical energy to said memory means when said first source is inoperative or disconnected from said labeling machine, said circuit means including isolation means for isolating said first, second and third means so that said second source of electrical energy is operative to provide electrical energy only to said memory means.

2. A hand-held labeling machine as recited in claim 1 wherein said first, second and third means are operative to provide three different voltages to said memory means.

3. A hand-held labeling machine as recited in claim 2 wherein said first means is operative to provide the highest voltage to said memory, said second means is operative to provide an intermediate voltage, and said third means is operative to provide the lowest voltage.

4. A hand-held labeling machine as recited in claim 1 wherein said isolation means includes a plurality of diodes.

5. A machine comprising; a housing having means for holding a label supply roll of a composite web having labels releaseably adhered to a backing strip, means for connecting a first source of electrical energy to said labeling machine, an on-off switch interposed between said connecting means and said labeling machine and having a first terminal coupled to said connecting means and a second terminal coupled to said labeler, means for printing on a label at a printing position, means for peeling the printed label from the backing strip, label applying means disposed adjacent the peeling means, means for advancing the web to peel a printed label from the backing strip at the peeling means and advance the printed label into label applying relationship with the label applying means and to advance another label into the printing position, means for entering selected data to be printed, the printing means including a thermographic print head having a plurality of individually selectable print elements powered by the source of electrical energy for printing on a thermographic label at the printing position, means coupled to said data entering means for electrically processing the selected data and energizing the individual print elements in a predetermined sequence determined by the selected data to print data on the label, said processing means including memory means of the type requiring the continuous application of electrical energy thereto to maintain the memory function, circuit means having first means electrically coupled to said second terminal for automatically applying electrical energy from said source to said labeling machine and said memory means when said on-off switch is on, said circuit means having second means electrically coupled to said first terminal for automatically applying electrical energy from said source to said memory means when said on-off switch is off, said circuit means further including third means electrically coupled to a second source of electrical energy for automatically applying electrical energy from said second source of electrical energy to said memory means when said first source is inoperative or disconnected from said labeling machine, said circuit means including isolation means for isolating said first, second and third means so that said second source of electrical energy is operative to provide electrical energy only to said memory means.

6. A hand-held labeling machine comprising; a housing having a manually engageable handle, the housing having means for holding a label supply roll of a composite web having labels releaseably adhered to a backing strip, means for connecting a first source of electrical energy to said labeling machine, an on-off switch interposed between said connecting means and said labeling machine and having a first terminal coupled to said connecting means and a second terminal coupled to said labeler, means for printing on a label at a printing position, means for peeling the printed label from the backing strip, label applying means disposed adjacent the peeling means, means for advancing the web to peel a printed label from the backing strip at the peeling means and advance the printed label into label applying relationship with the label applying means and to advance another label into the printing position, means for entering selected data to be printed, the printing means including a thermographic print head having a plurality of individually selectable print elements powered by the source of electrical energy for printing on a thermographic label at the printing position, means coupled to said data entering means for electrically processing the selected data and energizing the individual print elements in a predetermined sequence determined by the selected data to print data on the label, said processing means including memory means of the type requiring the continuous application of electrical energy thereto to maintain the memory function, circuit means having first means electrically coupled to said second terminal for automatically applying electrical energy from said source to said labeling machine and said memory means when said on-off switch is on, said circuit means having second means electrically coupled to said first terminal for automatially applying electrical energy from said source to said memory means when said on-off switch is off, said circuit means further including third means electrically coupled to a second source of electrical energy for automatically applying electrical energy from said second source of electrical energy to said memory means when said first source is inoperative or disconnected from said labeling machine, said circuit means including isolation means for isolating said first, second and third means so that said second source of electrical energy is operative to provide electrical energy to said memory means.

* * * * *

UNITED STATES PATENT AND TRADEMARK OFFICE

CERTIFICATE OF CORRECTION

PATENT NO. : 4,737,229

DATED : April 12, 1988

INVENTOR(S) : JAMES L. VANDERPOOL et al.

It is certified that error appears in the above-identified patent and that said Letters Patent is hereby corrected as shown below:

Column 2, line 21, delete "weo" and substitute therefor --web--.

Column 4, line 1, delete "exits" and substitute therefor --exists--.

Column 4, line 12, after "such" insert --as--.

Column 5, line 10, delete "strooed" and substitute therefor --strobed--.

Column 6, line 60, delete "tne" and substitute therefor --the--.

Column 8, line 18, delete "commano" and substitute therefor --command--.

Column 10, line 25, delete "characeristics" and substitute therefor --characteristics--.

UNITED STATES PATENT AND TRADEMARK OFFICE

CERTIFICATE OF CORRECTION

PATENT NO. : 4,737,229

DATED : April 12, 1988

INVENTOR(S) : James L. Vanderpool et al

It is certified that error appears in the above-identified patent and that said Letters Patent is hereby corrected as shown below:

Column 12, line 60, delete "reacn" and substitute therefor --reach--.

Signed and Sealed this

Eighth Day of November, 1988

*Attest:*

DONALD J. QUIGG

*Attesting Officer*

*Commissioner of Patents and Trademarks*